US007595459B2

(12) United States Patent
Oh

(10) Patent No.: US 7,595,459 B2
(45) Date of Patent: Sep. 29, 2009

(54) BUTTON DISPLAY APPARATUS OF REFRIGERATOR

(75) Inventor: Seung-Jin Oh, Daegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/646,592

(22) Filed: Dec. 28, 2006

(65) Prior Publication Data

US 2007/0151836 A1 Jul. 5, 2007

(30) Foreign Application Priority Data

Jan. 3, 2006 (KR) ..... 10-2006-0000669

(51) Int. Cl.
*H01H 13/14* (2006.01)

(52) U.S. Cl. ..... 200/333; 200/341; 200/314

(58) Field of Classification Search ..... 200/292–296, 200/310, 313, 314, 317, 341, 345, 333, 302.1, 200/302.2, 520
See application file for complete search history.

(56) References Cited

U.S. PATENT DOCUMENTS 5,760,352 A * 6/1998 Ishihara et al. ..... 200/16 D
5,801,345 A * 9/1998 Mikula-Curtis et al. ..... 200/5 A
6,747,226 B2 * 6/2004 Watanabe ..... 200/520
7,172,303 B2 * 2/2007 Shipman et al. ..... 362/29
7,193,170 B2 * 3/2007 Katayama et al. ..... 200/314

* cited by examiner

*Primary Examiner*—Renee S Luebke
*Assistant Examiner*—Marina Fishman
(74) *Attorney, Agent, or Firm*—Ked & Associates LLP

(57) ABSTRACT

The present invention discloses a button display apparatus of a refrigerator which can improve an illumination effect of operation buttons by condensing light of lamps for illuminating display characters or contours of the operation buttons on the operation buttons. The button display apparatus of the refrigerator includes: a control board; switches installed on the front surface of the control board, for recognizing external operations; lamps mounted on the front surface of the control board around the switches, for irradiating light according to the recognition operations of the switches; a cover installed to cover the front surface of the control board, and composed of button printed units; contact units for displaying operation ranges of the user on parts of the button printed units; and condensing members for covering the paths from the lamps to the contact units, so that the light generated by the lamps can reach the contact units.

24 Claims, 7 Drawing Sheets

BUTTON DISPLAY APPARATUS OF REFRIGERATOR

TECHNICAL FIELD

The present invention relates to a button display apparatus of a refrigerator, and more particularly, to a button display apparatus of a refrigerator which can improve an illumination effect of operation buttons by condensing light of lamps for illuminating display characters or contours of the operation buttons on the operation buttons.

BACKGROUND ART

In general, a refrigerator includes a controller for controlling a temperature, humidity, illumination etc. of storage chambers such as a refrigerating chamber and a freezing chamber. The controller controls the temperature, etc. of the storage chambers according to the manipulation of the user or the default preset in a built-in storage device.

Preferably, the controller is disposed on a front surface of a door installed on the front surface of the refrigerator for easy use.

Referring to FIG. 1, the controller 20' of the conventional refrigerator 10 is inserted into the front surface of the door 11 covering the front surface of the storage chamber of the refrigerator 10 with its front surface exposed.

As illustrated in FIGS. 2 to 4, the controller 20' includes a control board 21', a cover 30' and buttons.

The control board 21' is a circuit board electrically connected to each device of the refrigerator 10, for controlling the devices. The control board 21' is fixedly inserted into the front surface of the door 11 of the refrigerator 10.

A liquid crystal screen is a general liquid crystal screen for displaying the control contents of the control board 21' by pictures or characters. Preferably, the liquid crystal screen is installed at the center of the cover 30'.

The buttons include switches 50', lamps 51' and button printed units 31'.

The switches 50' are adhered to the front surface of the control board 21'. The switches 50' sense static electricity of the user touching contact units adjacent to the switches 50', and transmit input signals to the control board 21', respectively.

The switches 50' are installed in multiple points on the whole surface of the control board 21' as many as the buttons of the controller 20'.

The buttons include the button printed units 31'. The button printed units 31' are disposed in multiple points on the front surface of the cover 30' to correspond to the switches 50' in the forward direction. The button printed units 31' are composed of printed marks, pictures or characters for indicating the positions of the switches 50'. Each of the button printed units 31' includes a contact unit 32' and a light emitting slit 33'.

In addition, the button printed units 31' can be composed of transparent or translucent characters or pictures, for externally transmitting the light emitted from the lamps 51' discussed later.

The cover 30' covers the front surface of the control board 21' to protect the control board 21' from external shock. Considering that the switches 50' sense static electricity, the cover 30' is preferably made of glass which prevents direct contact between the user and the switches 50' and improves conductivity of the static electricity generated by the user.

The cover 30' is formed in a rectangular board shape to correspond to the front surface of the control board 21', for covering the front surface of the control board 21'.

The cover 30' can also be made of flexible resin, so that the user can easily contact and click the buttons.

The contact units 32' are formed as parts of the cover 30', and disposed at the front portions of the switches 50'. The operations and names of the switches 50' are printed on the contact units 32'.

The operation ranges of the switches 50', namely, the ranges of sensing static electricity of the user are marked on the contact units 32'.

The light emitting slits 33' are composed of marks or characters for indicating the contours of the contact units 32' or the positions of the switches 50', respectively.

The lamps 51' are turned on or off by short of the switches 50', and fixedly installed at one side of the switches 50', respectively.

The lamps 51' are light emitting diodes each respectively formed by laminating semiconductors, connecting an electrode to the laminated semiconductors, and covering the resulting semiconductor chip with resin or glass.

When the user intends to manipulate the controller 20', the user touches the contact unit 32' formed at the part of the cover 30'. The switch 50' installed inside the contact unit 32' touched by the user is operated by sensing static electricity generated by the user. An input signal generated by the operation of the switch 50' is transmitted to the control board 21', for operating the circuit of the control board 21'. Therefore, the corresponding device of the refrigerator 10 is controlled.

In addition, when the switch 50' is operated, power is applied to the lamp 51' connected to the switch 50', for making the lamp 51' emit light. As shown in FIG. 4, the light generated by the lamp 51' is emitted from the front surface of the control board 21' to the inner surface of the cover 30'.

The light of the lamp 51' emitted to the inner surface of the cover 30' is externally emitted from the cover 30' through the light emitting slit 33' including the transparent or translucent portion printed in the button character or picture shape of the button printed unit 31' and the transparent or translucent portion printed in the contour shape of the contact unit 32'.

The light emitted from the lamp 51' is also irradiated to the other portions, such as the light emitting slits 33' of the other buttons adjacent to the light emitting slit 33', or the contour of the liquid crystal screen, and externally emitted.

In the above example, the user operates the pressure switches by clicking. However, the switches can be formed in various ways. For example, when the contact units are pressurized, a pair of terminals installed inside each contact unit are electrically conducted, for transmitting signals to the controller. As another example, when the contact units are pressurized, components such as pressurization rods installed inside the contact units mechanically pressurize the switches.

In the buttons of the controller 20' of the conventional refrigerator 10, the light is transmitted through the light emitting slits 33' corresponding to the buttons adjacent to the button touched by the user. As a result, the user cannot easily distinguish the clicked button from the adjacent buttons.

In addition, the light of the lamps 51' is diffused inside the cover 30', partially externally emitted through the light emitting slits 33', and mostly irradiated to the other portions. Accordingly, the intensity of the light irradiated through the light emitting slits 33' is weakened, so that the user cannot easily identify the buttons.

DISCLOSURE OF THE INVENTION

The present invention is achieved to solve the above problems. An object of the present invention is to provide a button display apparatus of a refrigerator which allows the user to easily recognize buttons of a controller of the refrigerator, by condensing light emitted by clicking the buttons on the buttons, button printed units for displaying regions corresponding to the buttons, contact units or light emitting slits.

Another object of the present invention is to provide a button display apparatus of a refrigerator which prevents the user from being confused about buttons of a controller of the refrigerator, by preventing light of lamps emitted by clicking the buttons from being irradiated to light emitting slits of the other buttons.

In order to achieve the above-described objects of the invention, there is provided a button display apparatus of a refrigerator, including: a control board; switches installed on the front surface of the control board, for recognizing external operations; lamps mounted on the front surface of the control board around the switches, for irradiating light according to the recognition operations of the switches; a cover installed to cover the front surface of the control board, and composed of button printed units; contact units for displaying operation ranges of the user on parts of the button printed units; and condensing members for covering the paths from the lamps to the contact units, so that the light generated by the lamps can reach the contact units.

According to another aspect of the present invention, there is provided a button display apparatus of a refrigerator, including: a board having switches for recognizing external operations; lamps mounted on the board around the switches, for irradiating light according to the recognition operations of the switches; a cover installed on the front surface of the button display apparatus, and composed of button printed units; contact units for displaying operation ranges of the user on parts of the button printed units; light emitting slits for transmitting the light of the lamps; and condensing members for covering the paths from the lamps to the light emitting slits, so that the light generated by the lamps can be transmitted through the light emitting slits.

According to yet another aspect of the present invention, there is provided a button display apparatus of a refrigerator, including: a board; switches installed on the front surface of the board, for recognizing external operations; lamps mounted on the board, for irradiating light according to the recognition operations of the switches; a cover installed to cover the front surface of the board, and composed of button printed units; contact units for displaying operation ranges of the user on parts of the button printed units to correspond to the switches; and condensing members for covering the paths from the lamps to the button printed units, so that the light generated by the lamps can reach the button printed units.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

Figure 1:
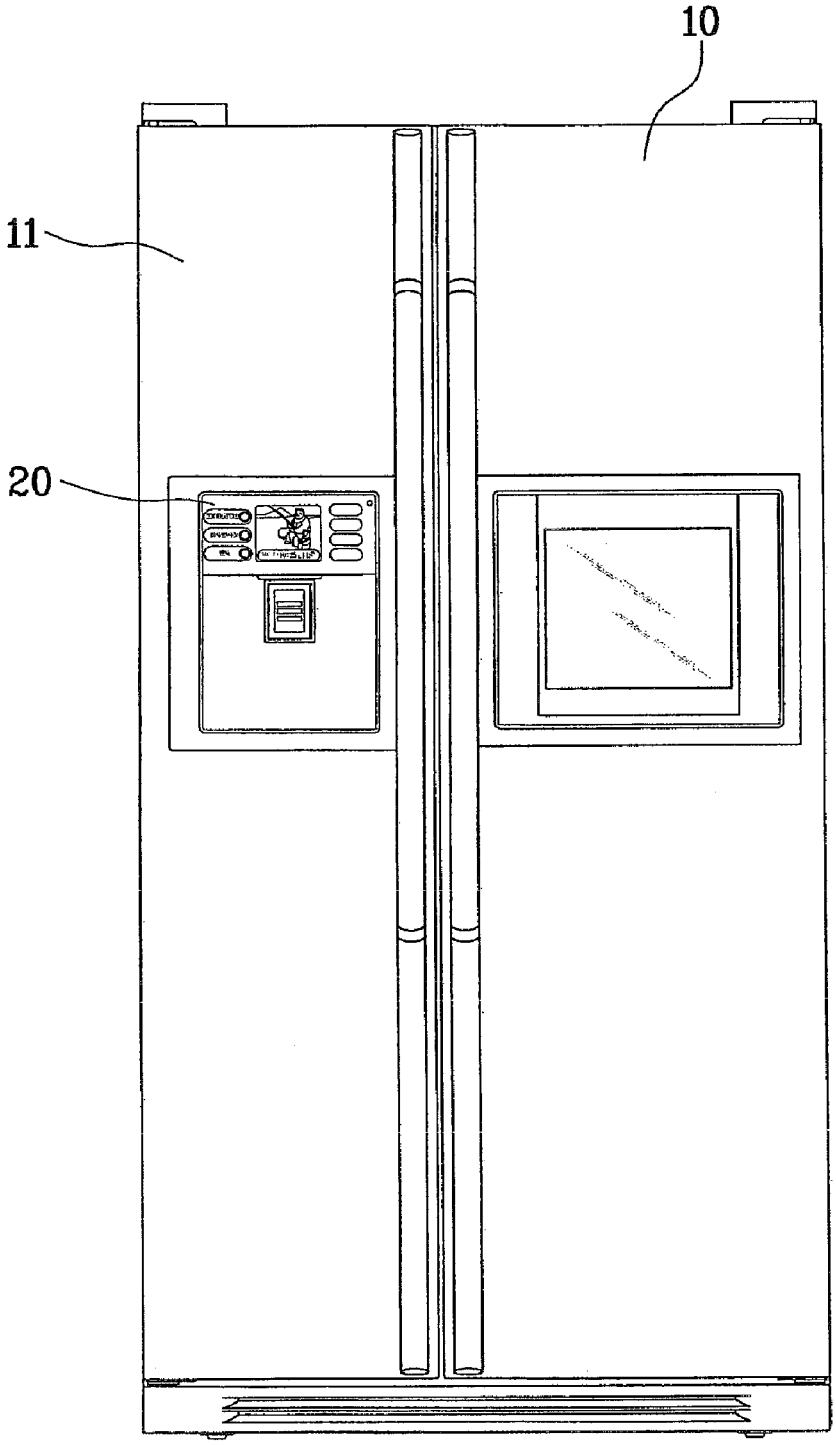
FIG.1 Related Art
FIG. 1 is a front view illustrating a conventional refrigerator.
Figure 2:
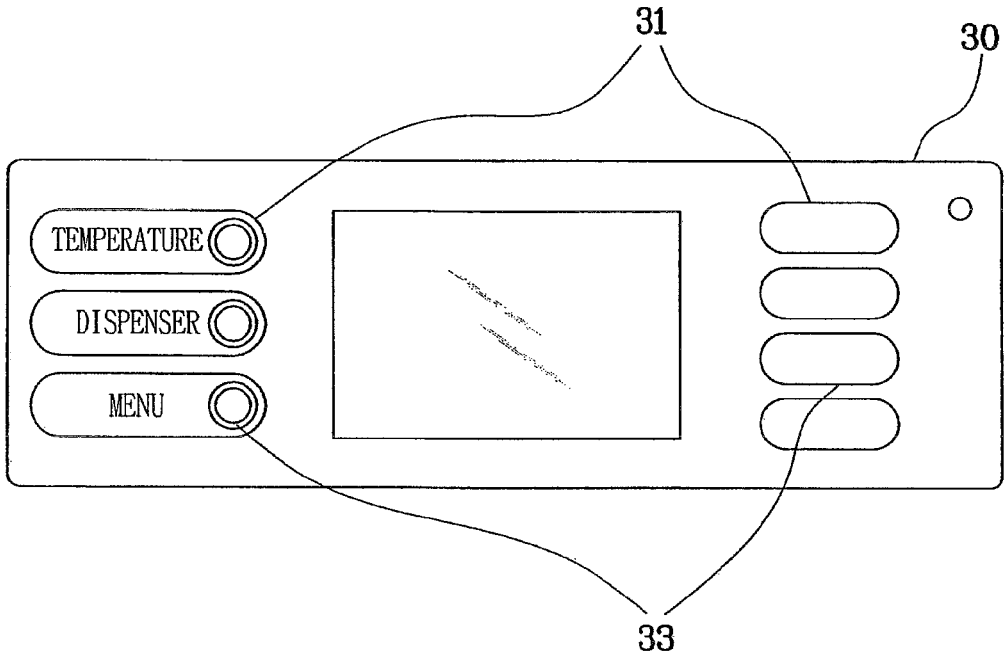
FIG.2 Related Art
FIG. 2 is a front view illustrating a cover of a controller of the conventional refrigerator.
Figure 3:
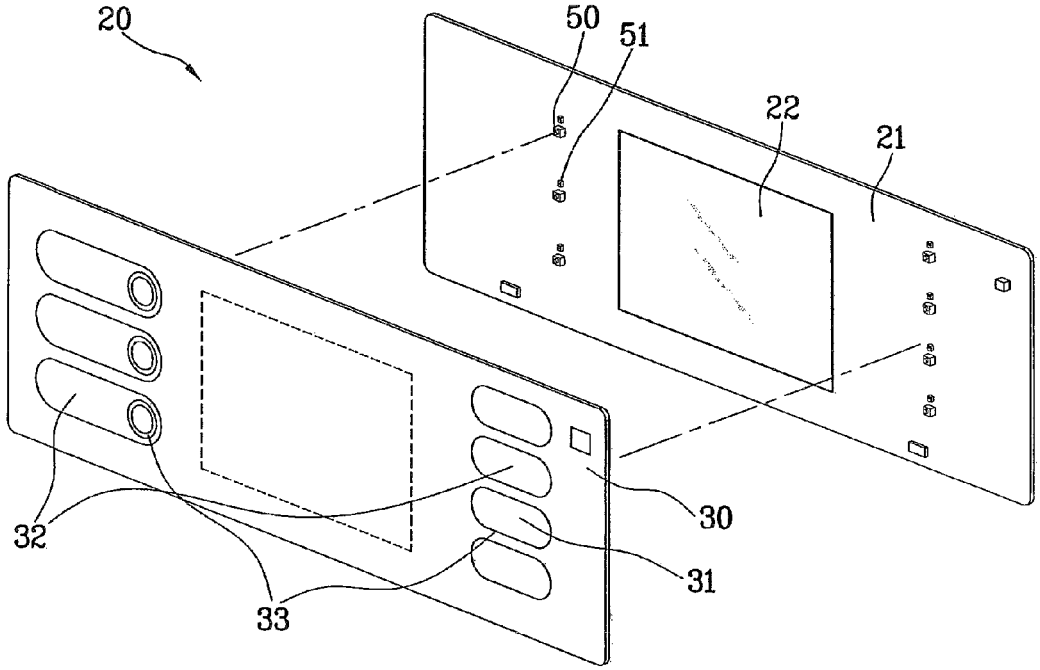
FIG.3 Related Art
FIG. 3 is a perspective view illustrating assembly/disassembly of the controller of the conventional refrigerator.
Figure 4:
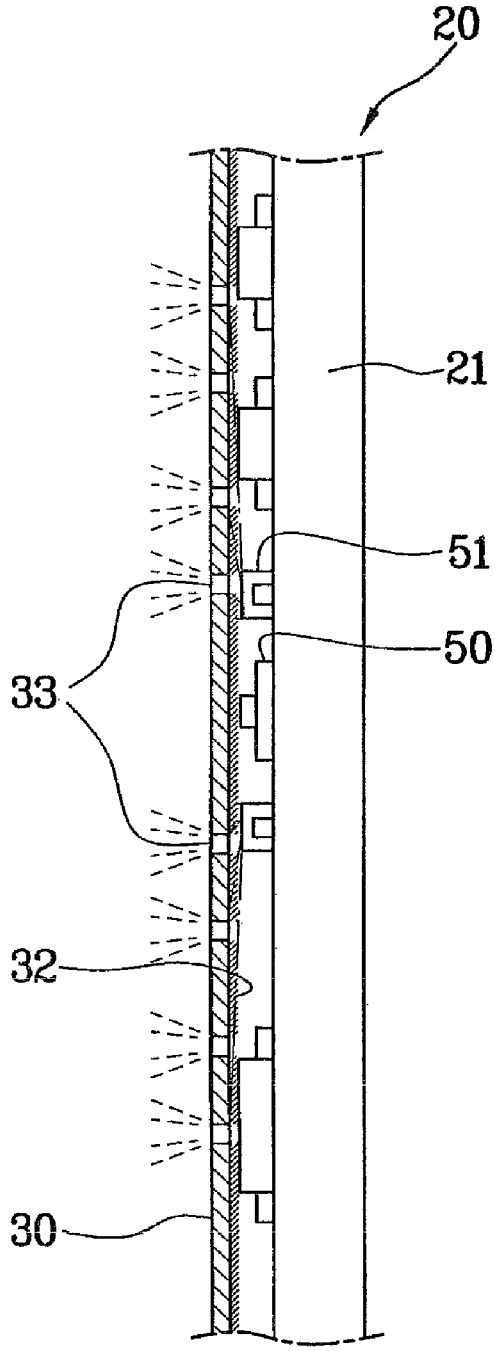
FIG.4 Related Art
FIG. 4 is a cross-sectional view illustrating buttons of the controller of the conventional refrigerator.

A button display apparatus of a refrigerator in accordance with preferred embodiments of the present invention will now be described in detail with reference to the accompanying drawings.

In the following description, same reference numerals are used for the same elements as those of FIGS. 1 to 4, and detailed explanations thereof are omitted.

Figure 5:
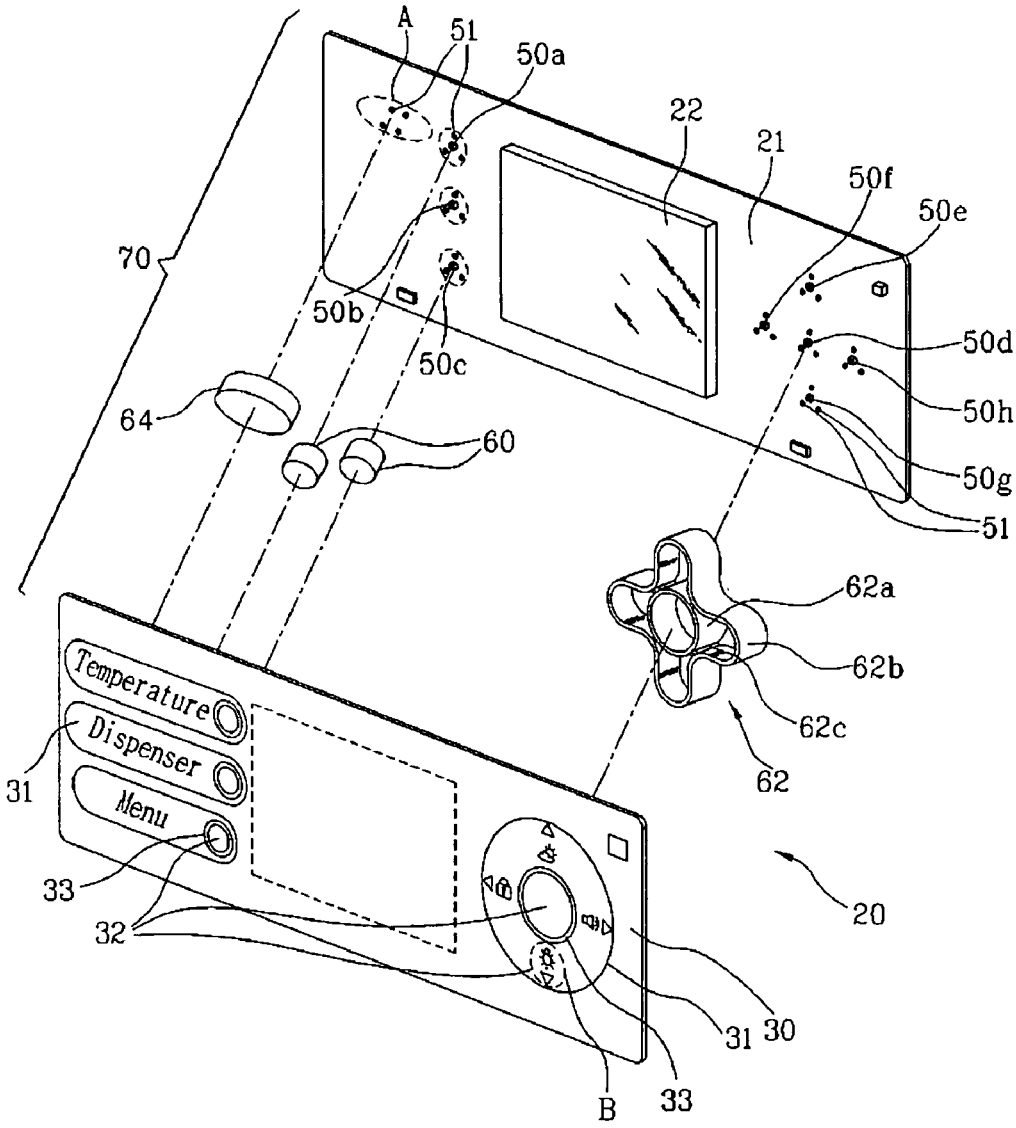
FIG. 5 is a perspective view illustrating assembly/disassembly of a button display apparatus of a refrigerator in accordance with the present invention.
Figure 6:
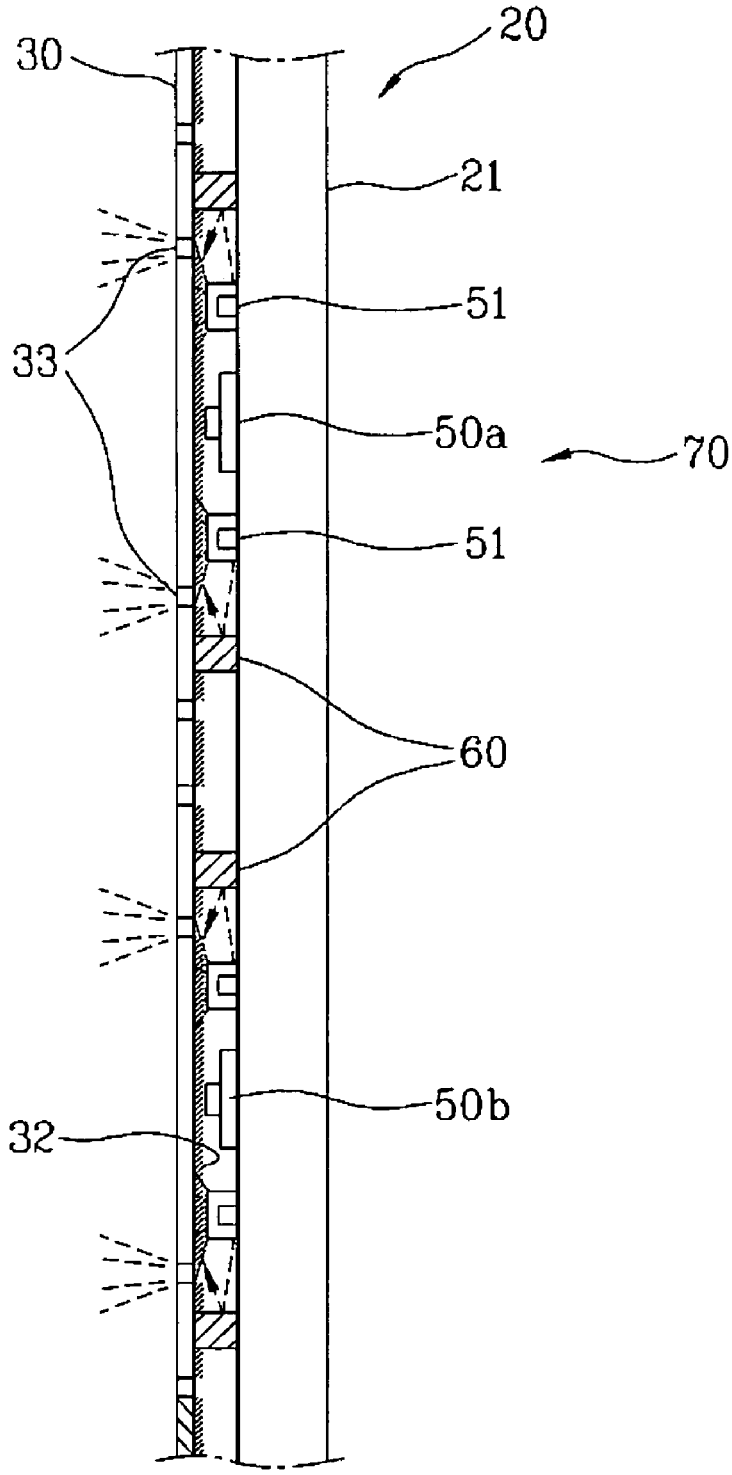
FIG. 6 is a cross-sectional view illustrating the button display apparatus of the refrigerator in accordance with the present invention.
Figure 7:
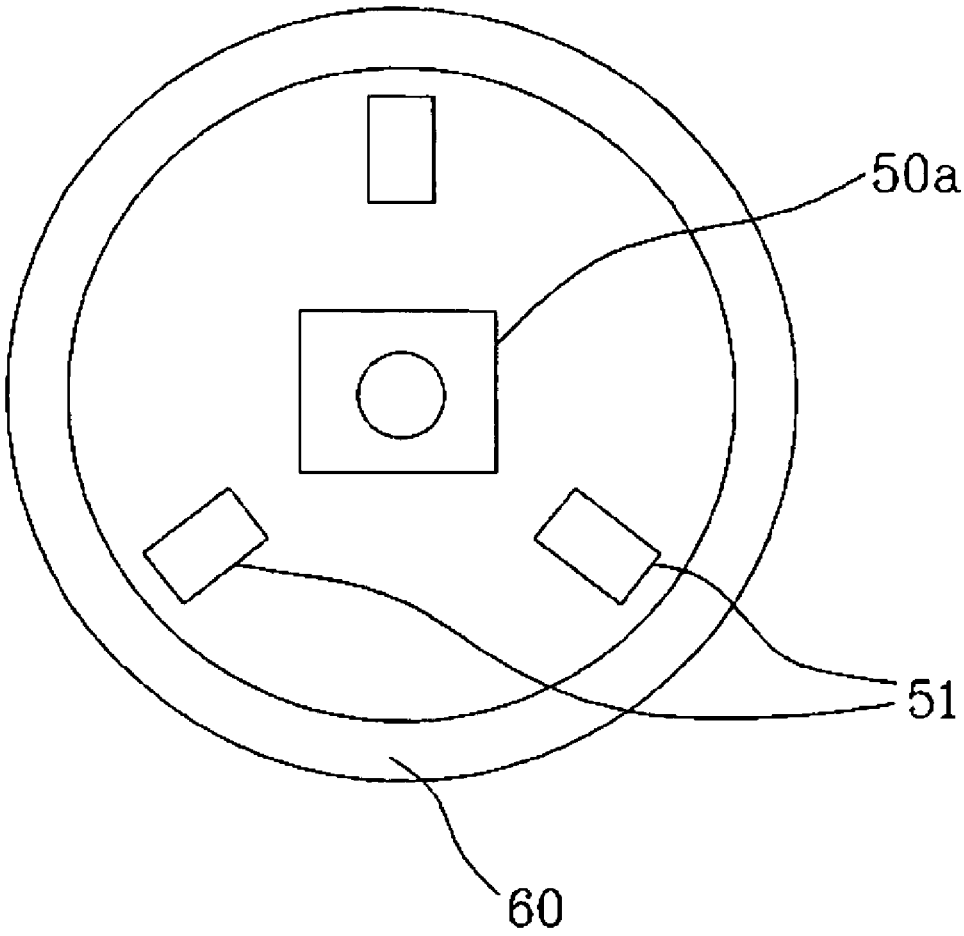
FIG. 7 is a plane view illustrating lamps in accordance with the present invention.

FIG. 5 illustrates a disassembly state of a controller 20 in accordance with the present invention, FIG. 6 illustrates a state where light is irradiated from lamps 51 by operations of buttons 70 in accordance with the present invention, and FIG. 7 illustrates the plurality of lamps 51 installed around switches 50*a* to 50*h* of the buttons 70 in accordance with the present invention.

In accordance with the present invention, condensing members 60, 62 and 64 are formed to condense light of the lamps 51 emitted by the operation of the button display apparatus 70 of the controller 20 of the refrigerator 10 on button printed units 31, contact units 32 or light emitting slits 33 formed on a cover 30 of the button display apparatus 70.

The controller 20 of the refrigerator 10 is normally disposed on a front surface of a door 11 installed on the front surface of the refrigerator 10. A liquid crystal screen 22 and the buttons 70 are externally exposed for the manipulation of the user.

The controller 20 is connected to each device of the refrigerator 10 directly or through a main microcomputer (not shown), for controlling a temperature, humidity, illumination, etc. of each storage chamber of the refrigerator 10.

The controller 20 includes a control board 21, the cover 30, the liquid crystal screen 22, and the button display apparatus 70.

The control board 21 is a circuit board connected to each device of the refrigerator 10, and composed of an arithmetic processing device and a storage device. In this embodiment, the control board 21 is fixedly inserted into a groove inwardly caved on the front surface of the door 11 of the refrigerator 10.

The cover 30 is installed to cover the front surface of the control board 21, and composed of operation portions for each switch 50*a* to 50*h* of the control board 21.

Preferably, the cover 30 is made of glass or resin to protect the control board 21 from alien substances, moisture, etc. More preferably, the cover 30 is made of a soft resin board for easy use.

The liquid crystal screen 22 includes a display device for displaying the control contents of the control board 21, the operation contents of the refrigerator 10, and the input contents of the user by characters and pictures.

The button display apparatus 70 includes the switches 50*a* to 50*h*, the lamps 51, the button printed units 31, the contact units 32, the light emitting slits 33 and the condensing members 60, 62 and 64.

The switches 50*a* to 50*h* are adhered to the front surface of the control board 21, and operated by the user. The switches 50*a* to 50*h* are connected to control circuits and devices of the refrigerator 10, for operating the control circuits and the devices.

In this embodiment, the switches 50*a* to 50*h* are static electricity switches operated by sensing static electricity generated by the user.

The lamps 51 are installed around the switches 50*a* to 50*h*. In this embodiment, the lamps 51 are light emitting diodes. In addition, the lamps 51 can be installed in region A which does not belong to the peripheral regions of the switches 50*a* to 50*h*. The region A faces the partial region of the button printed unit 31.

The light emitting diode lamps 51 include general light emitting diodes each respectively formed by forming a chip by connecting an electrode to laminated semiconductors and covering the chip with transparent glass or resin. When power is applied to the electrode, the semiconductors generate a magnetic field for emitting light.

The lamps 51 interwork with the switches 50*a* to 50*h*, respectively. When the switches 50*a* to 50*h* are operated, the corresponding lamps 51 are turned on. The interworking of the lamps 51 and the switches 50*a* to 50*h* is performed by connecting the lamps 51 directly to the switches 50*a* to 50*h*, or controlled by the controller 20. Here, the lamps 51 can be turned on during the operations of the corresponding switches 50*a* to 50*h*, turned on for a predetermined time after the operations of the corresponding switches 50*a* to 50*h*, or continuously turned on after the operations of the corresponding switches 50*a* to 50*h*. Especially, the lamps 51 mounted on the region A are turned on according to the operation of the corresponding switch 50*a*, for irradiating light to the 'temperature' portion which is a button mark of the button printed unit 31. The button marks of the button display units 31 are transparently or translucently printed, for transmitting light.

Preferably, the lamps 51 are installed in a multiple number, for improving the intensity of the light, and uniformly irradiating the light to the button printed units 31, the contact units 32 and the light emitting slits 33. In this embodiment, three lamps 51 are installed for a single switch 50.

The contact units 32 are parts of the cover 30 corresponding to the switches 50 in the forward direction. The contact units 32 are distinguished to be operated by the user.

Preferably, the contact units 32 are formed by transparently or translucently printing pictures, characters or boundary lines on parts of the cover 30 within the ranges of operating the corresponding switches 50 by contact of the user in the button printed units 31 of the cover 30.

The light emitting slits 33 are formed by transparently or translucently forming the contours of the contact units 32, for transmitting the light of the lamps 51. The lines which form characters and pictures for displaying the corresponding buttons 70 can be transparently or translucently formed on the contact units 32, for transmitting the light of the lamps 51. For example, in region B of FIG. 5, the light emitting slit 33 is not formed, but the button marks of the contact unit 32 and the button printed unit 31 are displayed together. The region B serves as the light emitting slit to transmit the light of the lamps 51.

In addition, in a state where pictures, characters or colors are printed on the whole cover 30 to intercept transmission of light, the light emitting slits 33 can be formed by transparently forming only the contours of the contact units 32, for transmitting light. That is, the light emitting slits 33 correspond to the contours (boundary lines) of the contact units 32 and the button marks of the button printed units 31.

The condensing members 60 are formed in a hollow tube shape to cover the paths from the lamps 51 to the light emitting slits 33, so that the light generated by the lamps 51 can be condensed on the light emitting slits 33.

Here, the condensing members 60 correspond in shape to the light emitting slits 33, and also correspond in installation shape to the lamps 51. In this embodiment, since the lamps 51 are arranged in a circular shape around the switches 50 and the contact units 32 and the light emitting slits 33 are formed in a circular shape, the condensing members 60 are formed in a circular tube shape to cover the circularly-arranged lamps 51 and also cover the circular light emitting slits 33 forming the contours of the contact units 32. That is, the condensing members 60 are the circular tubes extended from the lamps 51 to the light emitting slits 33. The condensing members 60 are fixedly mounted on the rear surface of the cover 30 or the front surface of the control board 21.

In the case that the plurality of switches 50*d* to 50*h* are collectively installed and the plurality of lamps 51 are installed around each switch 50*d* to 50*h*, the condensing member 62 is installed to house all the switches 50*d* to 50*h* and the lamps 51. The condensing member 62 includes an inner condensing member 62*a* for covering the switch 50*d* and the peripheral lamps 51, an outer condensing member 62*b* for covering the switches 50*e* to 50*h* and the peripheral lamps 51, respectively, and connection members 62*c* for connecting the inner condensing member 62*a* to the outer condensing member 62*b*, and partitioning off the outer condensing member 62*b* according to the positions of the switches 50*e* to 50*h*.

The condensing member 64 can be formed in a tube shape to cover the lamps 51 mounted on the region A, regardless of the switches 50. However, the lamps 51 mounted on the region A are turned on according to the operation of the switch 50*a* in the same button printed unit 31.

Preferably, the inner surfaces of the condensing members 60, 62 and 64 are made of a light reflecting material or coated with the light reflecting material, for reflecting the light generated by the lamps 51 to the button printed units 31, the contact units 32 and the light emitting slits 33. That is, the light of the lamps 51 is not externally leaked from the condensing members 60, 62 and 64.

In this embodiment, the condensing members 60, 62 and 64 are preferably made of resin with high light reflectance and low light transmittance.

The condensing members 60, 62 and 64 can have different cylindrical shapes at the lamp sides 51 and the light emitting slit sides 33.

In this embodiment, the user operates the pressure switches 50*a* to 50*h* by clicking. However, the switches can be formed in various ways. For example, when the contact units are pressurized, a pair of terminals installed inside each contact unit are electrically conducted, for transmitting signals to the controller. As another example, when static electricity of the user is electrically conducted to terminals installed in the contact units, static electricity switches sense the static electricity and transmit signals to the controller. As yet another example, when the contact units are pressurized, components such as pressurization rods installed inside the contact units mechanically pressurize the switches.

The light emitting operation of the lamps of the buttons of the controller of the refrigerator in accordance with the present invention will now be explained. In this embodiment, the switch 50*a* is exemplified.

When the user touches the contact unit 32 of the cover 30 installed on the front surface of the controller 20 of the refrigerator 10 generally with his/her finger to manipulate the controller 20, the switch 50*a* installed inside the contact unit 32 is operated by sensing static electricity electrically conducted in the finger of the user.

As the switch 50*a* is operated, the control board 21 corresponding to the switch 50*a* or the device of the refrigerator 10 connected to the switch 50*a* is controlled, and the lamps 51 connected to the switch 50*a* are turned on.

The lamps 51 are installed around the switch 50*a* in a multiple number, and turned on at the same time. The light generated by the lamps 51 is irradiated to the light emitting slit 33 formed at the contour or center of the contact unit 32 at the front portions of the lamps 51.

The light generated by the lamps 51 and irradiated to the light emitting slit 33 is externally emitted through the transparent light emitting slit 33. Therefore, the light emission of the light emitting slit 33 is observed outside the cover 30.

In addition, the light emitted from the lamps 51 is irradiated to the inner surface of the condensing member 60 covering and communicating with the peripheral regions of the lamps 51 and the light emitting slit 33. The light irradiated to the inner surface of the condensing member 60 is reflected and partially externally emitted through the light emitting slit 33.

Since the condensing member 60 is connected from the lamps 51 to the light emitting slit 33 and externally sealed up, the light irradiated to the inner surface of the condensing member 60 is transmitted merely through the light emitting slit 33 inside the condensing member 60. As a result, most of the light irradiated to the inner surface of the condensing member 60 is externally emitted through the light emitting slit 33.

That is, the light irradiated directly by the lamps 51 is transmitted through the light emitting slit 33, and most of the light reflected by the condensing member 60 is externally transmitted through the light emitting slit 33. Accordingly, the amount of the light transmitted through the light emitting slit 33 increases, so that the light emitting slit 33 can be illuminated more bright.

The light generated by the lamps 51 around the switch 50*a* is transmitted merely through the light emitting slit 33 corresponding to the switch 50*a* by the condensing member 60, but not transmitted through the light emitting slits 33 adjacent to the light emitting slit 33. That is, only the light emitting slit 33 corresponding to the contact unit 32 touched by the user is illuminated. The light emitting slit 33 corresponding to the contour of the contact unit 32 operated by the user distinguishes itself, so that the user can easily recognize the light emitting slit 33 and the contact unit 32.

The lamps 51 in the region A emit light with the other lamps 51 according to the operation of the switch 50*a*, and intensively irradiate the light to the button mark of the button printed unit 31 by the condensing member 64.

The plurality of lamps 51 are installed around the switch 50*a*, for increasing the intensity of the light, so that the user can easily recognize the light emitting slit 33 and the button mark.

In this embodiment, the plurality of lamps 51 are installed around the switches 50*a* to 50*h* to improve the luminous intensity of the light on the light emitting slits 33. The light generated by the lamps 51 is not lost by using the condensing members 60, 62 and 64, and is efficiently transmitted through the button printed units 31, the contact units 32 and the light emitting slits 33. Therefore, a single lamp 51 can be preferably installed for a single switch 50. In the case that the plurality of lamps 51 are installed around the single switch 50, the luminous intensity is more improved on the button printed units 31, the contact units 32 and the light emitting slits 33.

In this embodiment, the switches 50*a* to 50*h* are operated by clicking of the user. However, it is obvious that switches operated by a wire or wireless external controller such as a remote controller, mechanical switches or pressure switches can also be used as the switches 50*a* to 50*h* .

As discussed earlier, in accordance with the present invention, when the user operates the buttons of the controller of the refrigerator, the button printed units, the contact units and the light emitting slits which correspond to the buttons are illuminated more bright. As a result, the user can easily recognize the buttons.

In addition, among the buttons of the controller of the refrigerator, only the button operated by the user emits light, and the other buttons do not transmit the light. Accordingly, the user can easily recognize the operated button.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A button display apparatus of a refrigerator, comprising:

a control board;

switches installed on a front surface of the control board;

lamps mounted on the front surface of the control board adjacent the switches;

a cover installed to cover the front surface of the control board, wherein button printed units are formed on the cover;

contact units formed on at least some of the button printed units, wherein the contact units indicate where a user can touch the cover to activate a switch; and condensing members mounted between the control board and the cover, wherein at least some of the condensing members surround both a switch and at least one corresponding lamp adjacent the switch, wherein each condensing member conveys light from the at least one lamp to a corresponding button printed unit, and wherein the inner surfaces of the condensing members are made of a light reflecting material or coated with the light reflecting material, the light reflecting material reflecting the light generated by the lamps to the button printed unit.

2. The button display apparatus of claim 1, wherein the condensing members are tube shaped with open ends.

3. The button display apparatus of claim 1, wherein the lamps are light emitting diodes.

4. The button display apparatus of claim 1, wherein the contact units comprise light emitting slits that allow light generated by the lamps to pass through the cover.

5. The button display apparatus of claim 1, wherein the contact units comprise transparent or translucent portions of the cover.

6. The button display apparatus of claim 2, wherein a first open end of each condensing member surrounds a switch and at least one lamp, and wherein a second open end of each condensing member is positioned adjacent a contact unit.

7. The button display apparatus of claim 1, wherein a plurality of lamps are positioned around at least one of the switches, and wherein the condensing member corresponding to the at least one switch surrounds the switch and the plurality of lamps positioned around the at least one switch.

8. The button display apparatus of claim 1, wherein a first end of at least one of the condensing units surrounds a lamp but not a switch, and wherein a second end of the at least one condensing unit is positioned adjacent a button printed unit that does not include a contact unit.

9. The button display apparatus of claim 5, wherein a first one of the contact units comprises a circular shaped transparent or translucent portion of the cover that surrounds a portion of the cover that overlies a first switch.

10. The button display apparatus of claim 9, wherein a first condensing unit includes a first open end that surrounds the first switch and at least one lamp, and a second open end that surrounds the first contact unit.

11. The button display apparatus of claim 10, wherein a first plurality of lamps are mounted on the control board around the first switch, and wherein the first open end of the first condensing unit also surrounds the first plurality of lamps.

12. The button display apparatus of claim 1, wherein when a user touches a contact unit to activate a corresponding switch, at least one lamp located adjacent the switch is illuminated.

13. A button display apparatus of a refrigerator, comprising:

a board;

switches installed on a front surface of the board;

lamps mounted on the board adjacent the switches;

a covet installed to cover the front surface of the board, wherein button printed units are formed on the cover; and condensing members located between the board and the cover and fixed to one of the board and the cover, wherein each condensing member comprises a hollow tube having a first end that surrounds at least one lamp on the board and a second end that abuts a portion of the cover having a button printed unit, wherein each condensing member conveys light from the at least one lamp to the button printed unit to illuminate the button printed, and wherein the inner surfaces of the condensing members are made of a light reflecting material or coated with the light reflecting material, the light reflecting material reflecting the light generated by the lamps to the button printed unit.

14. The button display apparatus of claim 13, wherein the button printed units are transparent or translucent.

15. The button display apparatus of claim 13, wherein a first one of the condensing members has a first end that surrounds a first plurality of lamps, and wherein the first condensing member conveys light from the first plurality of lamps to a first button printed unit on the cover.

16. The button display apparatus of claim 15, wherein the first condensing unit also surrounds a switch.

17. The button display apparatus of claim 13, wherein the first end of at least one of the condensing members also surrounds a switch.

18. The button display apparatus of claim 13, wherein the cover further comprises contact units that indicate where a user can touch the cover to activate the switches.

19. The button display apparatus of claim 18, wherein a first one of the contact units comprises a transparent or translucent portion of the cover that surrounds a portion of the cover that overlies a first switch.

20. The button display apparatus of claim 19, wherein a first condensing unit has a first end that surrounds the first switch and at least one lamp, and wherein a second end of the first condensing unit surrounds the first contact unit.

21. The button display apparatus of claim 13, wherein a first one of the condensing members comprises:

a central hollow tube; and a plurality of peripheral hollow tubes that are attached to and that surround the central hollow tube.

22. The button display apparatus of claim 21, wherein a first end of the central hollow tube surrounds a central switch, and wherein first ends of each of the plurality of peripheral hollow tubes each surround a peripheral switch.

23. The button display apparatus of claim 13, wherein then a user activates a switch, at least one lamp adjacent the switch is illuminated for a predetermined period of time.

24. The button display apparatus of claim 13, wherein each condensing member prevents light from the lamp which it surrounds from illuminating a button printed unit that abuts a different condensing unit.

* * * * *